US009076566B2

(12) United States Patent
Kim et al.

(10) Patent No.: US 9,076,566 B2
(45) Date of Patent: Jul. 7, 2015

(54) DC POWER CABLE WITH SPACE CHARGE REDUCING EFFECT

(75) Inventors: Yoon-Jin Kim, Gunpo-si (KR); Jin-Ho Nam, Namyangju-si (KR); Ho-Souk Cho, Seoul (JP); Young-Ho Park, Anyang-si (KR); Son Tung Ha, Anyang-si (KR)

(73) Assignee: LS Cable Ltd., Anyang (KR)

( * ) Notice: Subject to any disclaimer, the term of this patent is extended or adjusted under 35 U.S.C. 154(b) by 281 days.

(21) Appl. No.: 12/886,972

(22) Filed: Sep. 21, 2010

(65) Prior Publication Data

US 2012/0012362 A1 Jan. 19, 2012

(30) Foreign Application Priority Data

Jul. 13, 2010 (KR) ..... 10-2010-0067454

(51) Int. Cl.

| | |
|---|---|
| ***H01B 3/30*** | (2006.01) |
| ***H01B 3/44*** | (2006.01) |
| ***H01B 7/295*** | (2006.01) |
| ***H01B 7/00*** | (2006.01) |
| ***H01B 3/00*** | (2006.01) |
| *H01B 9/02* | (2006.01) |

(52) U.S. Cl.
CPC ..... *H01B 3/004* (2013.01); *H01B 3/441* (2013.01); *H01B 9/027* (2013.01)

(58) Field of Classification Search
CPC ..... H01B 3/004; H01B 9/027
USPC ..... 174/110 SR, 118, 102 R, 109, 110 R, 174/102 SC, 120 SC
See application file for complete search history.

(56) References Cited

U.S. PATENT DOCUMENTS

| | | | | |
|---|---|---|---|---|
| 3,264,272 | A * | 8/1966 | Rees | 174/110 R |
| 4,677,026 | A * | 6/1987 | Hamamoto et al. | 428/404 |
| 5,028,478 | A * | 7/1991 | Odagiri et al. | 428/327 |
| 5,847,038 | A * | 12/1998 | Silence et al. | 524/430 |
| 2004/0029013 | A1 * | 2/2004 | Perego et al. | 429/233 |
| 2005/0211930 | A1 * | 9/2005 | DeMeo et al. | 250/516.1 |
| 2007/0256595 | A1 * | 11/2007 | Nozoe | 524/493 |

(Continued)

FOREIGN PATENT DOCUMENTS

| | | |
|---|---|---|
| CN | 1300085 A | 6/2001 |
| CN | 1834144 A | 9/2006 |

(Continued)

OTHER PUBLICATIONS

Copies provided of Lee (EP 1052654 A1) and Tojo (EP 0453262 A2).*

(Continued)

*Primary Examiner* — Chau N Nguyen
*Assistant Examiner* — Roshn Varghese
(74) *Attorney, Agent, or Firm* — NSIP Law

(57) ABSTRACT

Provided is a DC power cable including a conductor, an inner semiconductive layer, an insulation and an outer semiconductive layer. In particular, the inner semiconductive layer or the outer semiconductive layer may be formed from a semiconductive composition containing a polypropylene base resin or a low-density polyethylene base resin and carbon nano tubes; and the insulation may be formed from an insulation composition containing a polypropylene base resin or a low-density polyethylene base resin and inorganic nano particles. The resulting power cable may have improved properties such as volume resistivity, hot set, and so on, and excellent space charge reducing effect.

13 Claims, 4 Drawing Sheets

(56) References Cited

U.S. PATENT DOCUMENTS

| | | | | |
|---|---|---|---|---|
| 2008/0251757 | A1* | 10/2008 | Yamamoto et al. | 252/73 |
| 2010/0065311 | A1* | 3/2010 | Tanaka et al. | 174/257 |
| 2010/0078194 | A1* | 4/2010 | Bhatt et al. | 174/110 SR |
| 2010/0178487 | A1* | 7/2010 | Arai et al. | 428/323 |

FOREIGN PATENT DOCUMENTS

| | | | | |
|---|---|---|---|---|
| CN | 101445627 | A | 6/2009 | |
| CN | 101585943 | A | 11/2009 | |
| EP | 453262 | A2 * | 10/1991 | C08F 8/18 |
| EP | 1052654 | A1 * | 11/2000 | H01B 3/44 |
| JP | 2541034 | | 7/1996 | |
| JP | 09-245521 | | 9/1997 | |
| JP | 2000-357419 | | 12/2000 | |
| JP | 3430875 | | 5/2003 | |
| JP | 2004-363020 | A | 12/2004 | |
| JP | 2007-103247 | A | 4/2007 | |
| JP | 2007-168500 | | 7/2007 | |
| JP | 2010-121056 | | 6/2010 | |
| KR | 10-2010-0012591 | A | 2/2010 | |

OTHER PUBLICATIONS

J-Power Systems Corp (JP 2007-103247) (English Machine Translation provided).*

Wikipedia Article on Cross-Linked Polyethelyene Jan. 24, 2013.*

"New Generation of Powder Processor for Precision Mixing and Composite Treatment Technology", Hosokawa Micron Corporation, retrieved from: (http://www.alpinehosokawa.com/downloads/powder/brochures/brochure_nobilta_eng.pdf), Apr. 30, 2013.

"Hybridization System" Nara Machinery Co., Ltd., retrieved from: http://www.aaamachine.com/products/other/pdf/Hybridization_NHS_NaraMachinery.pdf), Apr. 30, 2013.

* cited by examiner

DC POWER CABLE WITH SPACE CHARGE REDUCING EFFECT

CROSS-REFERENCE TO RELATED APPLICATION(S)

This application claims the benefit under 35 U.S.C. §119 (a) of Korean Patent Application No. 10-2010-0067454, filed on Jul. 13, 2010, in the Korean Intellectual Property Office, the entire disclosure of which is incorporated herein by reference for all purposes.

BACKGROUND

1. Field

The following description relates to a direct current (DC) power cable with excellent space charge reducing effect.

2. Description of Related Art

A power cable being currently used in the country includes a conductor 1, an inner semiconductive layer 2, an insulation 3, an outer semiconductive layer 4, a lead sheath 5, and a polyethylene (PE) sheath 6, as shown in FIGS. 1A and 1B.

Crosslinked polyethylene (XLPE) has been widely used as the insulation 3 of the power cable. However, because XLPE is difficult to recycle, increasingly strict restrictions for global environmental protection may prevent the use of XLPE. Also, when premature crosslinking or scorch occurs to XLPE, a long-term extrusion performance may disadvantageously reduce, resulting in ununiform production capability. Furthermore, when XLPE is subject to a crosslinking process using a crosslinking agent, crosslinking by-products such as alpha-methylstyrene or acetophenone may be generated. To remove the crosslinking by-products, a degassing process should be added, and as a result, the process time and cost increase.

Moreover, in case where a power cable with an insulation of XLPE is used as a high voltage transmission line, problems may occur. The worst problem is that when a high voltage DC is applied to the cable, a space charge is liable to generate due to movement of electric charges from an electrode into the insulation and the influence of crosslinking by-products. And, if such a space charge is accumulated in the insulation by a high voltage DC applied to the power cable, the electric field strength near a conductor of the power cable increases, and the breakdown voltage of the cable reduces.

To solve the problem, solutions have been suggested to form an insulation using magnesium oxide. Magnesium oxide basically has a face centered cubic (FCC) crystal structure, but may have various shapes, purity, crystallinity and properties depending on synthesis methods. The shape of magnesium oxide includes cubic, terrace, rod-like, porous and spherical shapes, as shown in FIGS. 2A to 2E, and each shape may be used depending on specific properties. In particular, spherical magnesium oxide is used to suppress a space charge of a power cable, as suggested in Japanese Patent Nos. 2541034 and 3430875. As mentioned above, studies have been steadily made to suppress a space charge in a power cable with an insulation.

However, in the conventional DC power cable, a large amount of carbon black is contained in a conductive composition used to form the inner semiconductive layer 2 or the outer semiconductive layer 4, relative to a base resin. A resulting DC power cable has an increase in volume and weight, and a reduction in dispersion of carbon black in the base resin.

Therefore, there is a need for studies on materials usable as conductive particles in place of carbon black.

SUMMARY

Provided is a DC power cable with an insulation that has a suppression effect of crosslinking by-products and space charges occurring during manufacturing and has improved extrusion performance.

Also provided is a DC power cable with a semiconductive layer containing new conductive particles in place of conventional carbon black.

A DC power cable includes a conductor, an inner semiconductive layer, an insulation and an outer semiconductive layer, wherein the inner or outer semiconductive layer is formed from a semiconductive composition containing a polypropylene base resin or a low-density polyethylene base resin and carbon nano tubes, and the insulation is formed from an insulation composition containing a polypropylene base resin or a low-density polyethylene base resin and inorganic nano particles.

A DC power cable has an excellent space charge suppression effect and improved extrusion performance as well as a reduction in volume and weight, and consequently a high utilization in various fields of industry.

In one general aspect, there is provided a direct current (DC) power cable including: a conductor, an inner semiconductive layer, an insulation, and an outer semiconductive layer, wherein at least one of the inner semiconductive layer or the outer semiconductive layer includes a semiconductive composition including: a polypropylene base resin or a low-density polyethylene base resin, and carbon nano tubes, and wherein the insulation includes an insulation composition including: a polypropylene base resin or a low-density polyethylene base resin, and inorganic nano particles.

The DC power cable may further include that the content of the carbon nano tubes is 1 to 6 parts by weight per 100 parts by weight of the base resin.

The DC power cable may further include that the semiconductive composition further includes, per 100 parts by weight of the base resin: 0.1 to 10 parts by weight of carbon black, and 0.1 to 0.5 parts by weight of an antioxidant.

The DC power cable may further include that the carbon nano tubes include multiwalled carbon nano tubes including a diameter between 5 and 20 nm and a purity of 98% or more.

The DC power cable may further include that the insulation composition includes 0.1 to 5 parts by weight of at least one kind of inorganic nano particles including at least one of: silicon dioxide ($SiO_2$), titanium dioxide ($TiO_2$), carbon black, graphite powder and surface-modified cubic magnesium oxide, per 100 parts by weight of the base resin.

The DC power cable may further include that the insulation composition further includes 0.1 to 0.5 parts by weight of an oxidant per 100 parts by weight of the base resin.

The DC power cable may further include that the magnesium oxide includes: a purity of 99.9% or more, and an average particle size of 500 nm or less.

The DC power cable may further include that the magnesium oxide is monocrystalline or polycrystalline.

Other features and aspects may be apparent from the following detailed description, the drawings, and the claims.

Figure 1A:
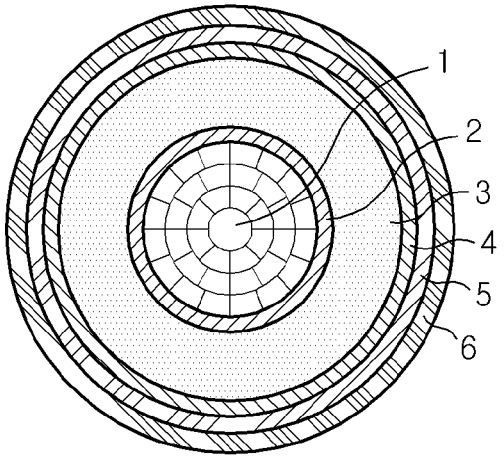
FIG. 1A is a cross-sectional view of a DC power cable.
Figure 1B:
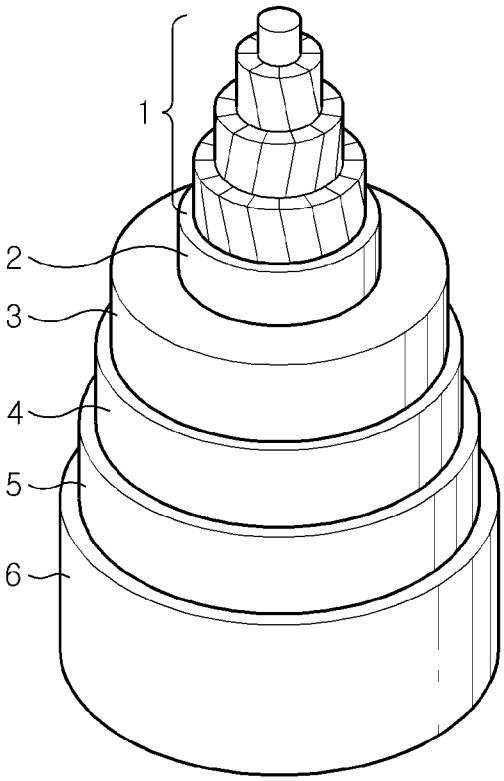
FIG. 1B is a view illustrating a structure of a DC power cable.
Figure 2A:
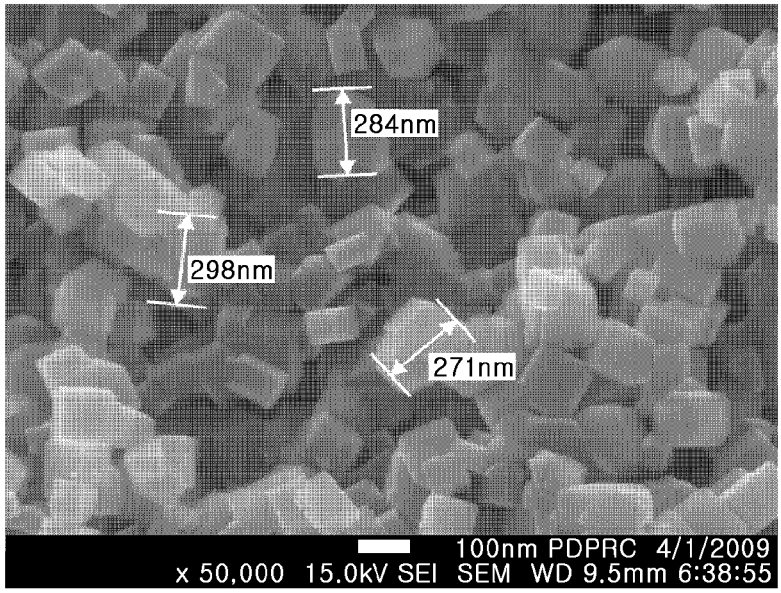
FIG. 2A is a scanning electron microscopy (SEM) image of cubic magnesium oxide.
Figure 2B:
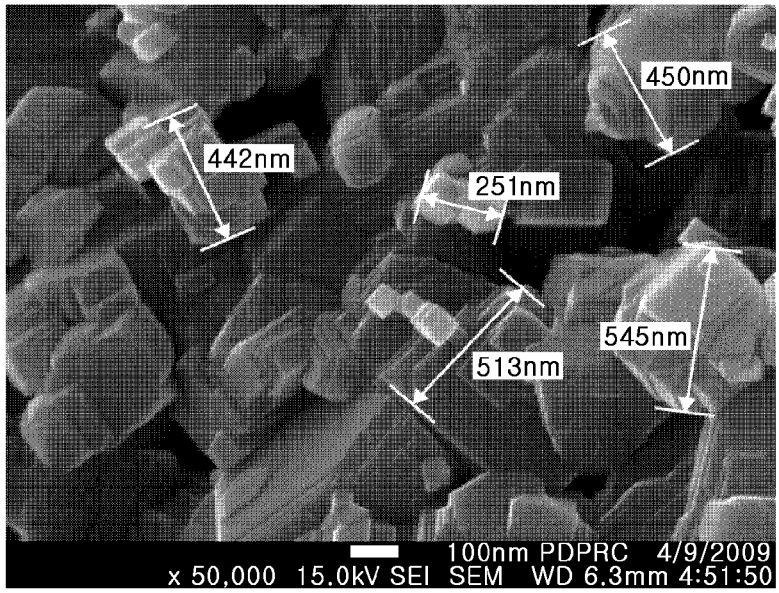
FIG. 2B is an SEM image of terrace magnesium oxide.
Figure 2C:
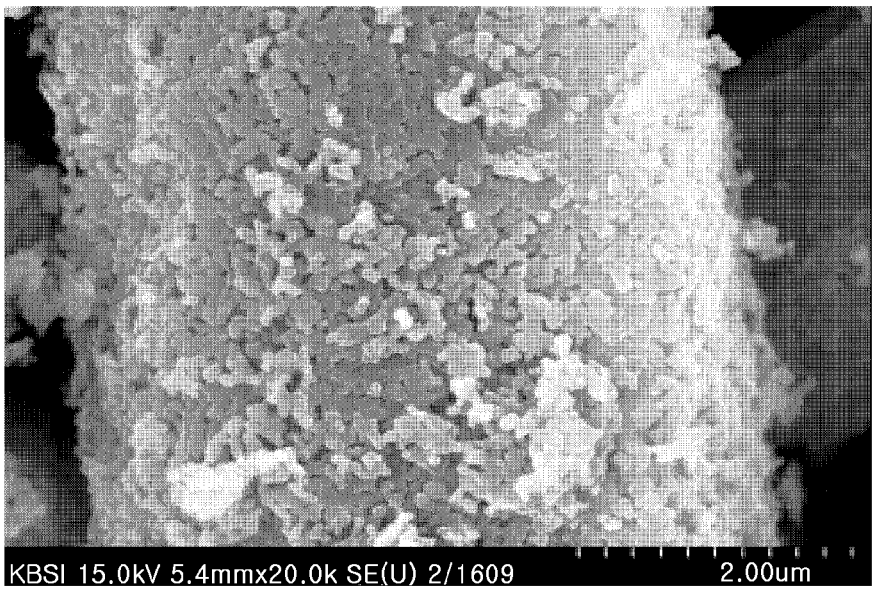
FIG. 2C is an SEM image of rod-like magnesium oxide.
Figure 2D:
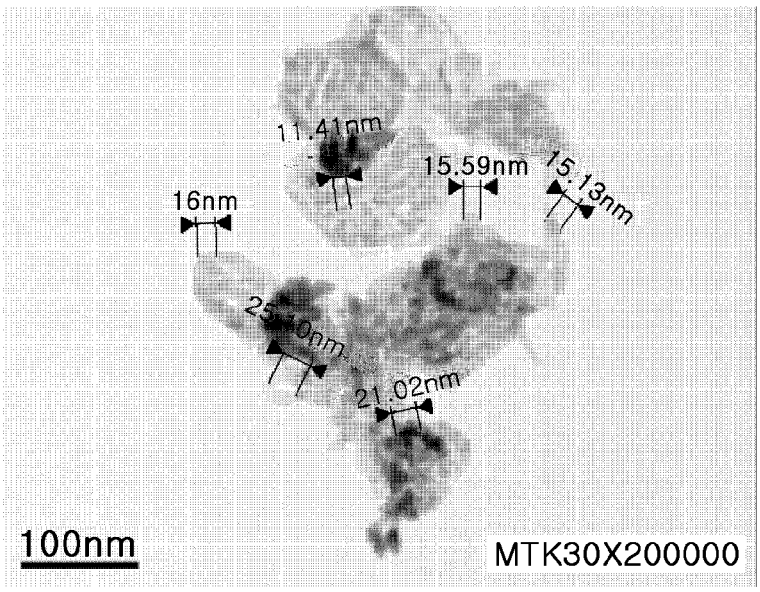
FIG. 2D is a transmission electron microscopy (TEM) image of porous magnesium oxide.
Figure 2E:
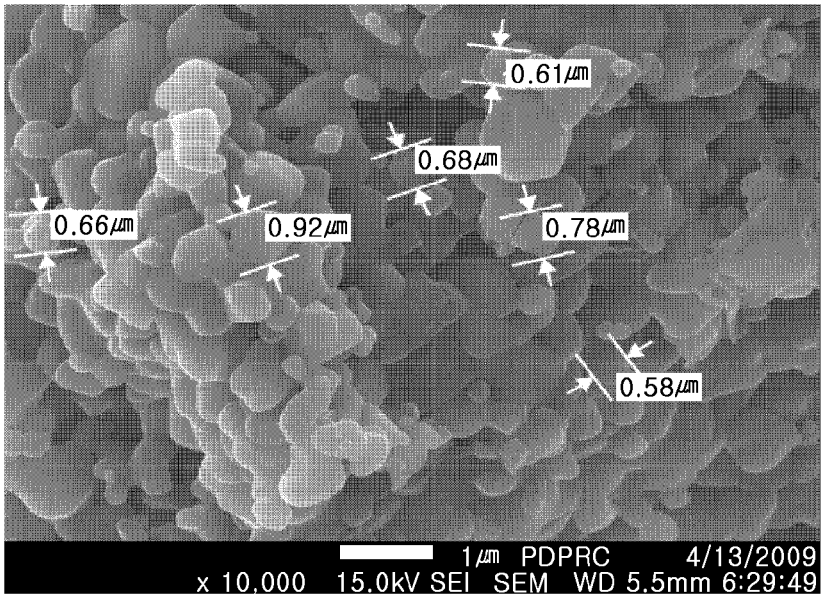
FIG. 2E is an SEM image of spherical magnesium oxide.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

A DC power cable of an embodiment includes a conductor 1, an inner semiconductive layer 2 surrounding the conductor 1, an insulation 3 surrounding the inner semiconductive layer 2, and an outer semiconductive layer 4 surrounding the insulation 3. Also, an embodiment may further include a sheath surrounding the outer semiconductive layer 4, and the sheath may include a lead sheath 5 and a polyethylene (PE) sheath 6.

The inner semiconductive layer 2 or the outer semiconductive layer 4 is formed from a semiconductive composition containing a polypropylene base resin or a low-density polyethylene (LDPE) base resin and carbon nano tubes The semiconductive composition includes 1 to 6 parts by weight of carbon nano tubes per 100 parts by weight of the base resin, and may further include 0.1 to 10 parts by weight of carbon black and/or 0.1 to 0.5 parts by weight of an antioxidant.

The polypropylene base resin of an embodiment has a melt index (MI) between 1 and 50. The polypropylene base resin is a copolymer of at least one monomer, e.g., C4 to C8 alpha-olefins and ethylene. The polypropylene base resin may be a random copolymer of alpha-olefin and/or ethylene.

The LDPE base resin of an embodiment may have a density between 0.85 and 0.95 kg/m$^3$ and a MI between 1 and 2.

The carbon nano tubes of the semiconductive composition may be multiwalled carbon nano tubes (MWCNT) including thin MWCNT, and may be produced by a typical synthesis method. The synthesis method may produce carbon nano tubes of high purity between 98% and 100% by removing a catalyst through liquid phase oxidation and removing amorphous carbon through high-temperature thermal treatment. The use of the high-purity carbon nano tubes may reduce the size of a protrusion occurring on a resulting inner or outer semiconductive layer. As a result, the inner or outer semiconductive layer may have a longer life, and contribute to a high-reliability cable. Also, in contrast with the conventional art using a high content of carbon black, a low content of carbon nano tubes are applied to the semiconductive composition of an embodiment, which allows smoothness of a semiconductive layer and thickness reduction of an insulation, resulting in a lightweight cable.

Also, although the carbon nano tubes are included in the semiconductive composition at a low content between 1 and 6 parts by weight, the carbon nano tubes can be easily bonded to the base resin, leading to improved dispersion of the carbon nano tubes in the base resin. One example may use carbon nano tubes with purity of 98% or as another example, thin MWCNT with a diameter between 5 and 20 nm and a length of several tens of micrometers. The use of the carbon nano tubes allows a reduction in the content of carbon black, and consequently, improved melt flow rate of the semiconductive composition and reduced load at extrusion, leading to improvement in extrusion performance. The improved extrusion performance may result in a reduction in process time and cost.

The dispersion of the carbon nano tubes in the base resin may be further improved in the following manner: first, the surface of the carbon nano tubes is functionalized using supercritical fluid extraction, liquid phase oxidation wrapping and so on, and then is mixed with the base resin of an embodiment using a Hensel type mixer or the like. The liquid phase oxidation wrapping method includes treating carbon nano tubes with an acidic solution, purifying the carbon nano tubes, and functionalizing the surface of the carbon nano tubes with a carboxyl group or the like.

Alternatively, the dispersion of the carbon nano tubes in the base resin may be further improved in the following manner: the base resin of an embodiment is dissolved in a good solvent of chlorobenzene such as ortho-1,2-dichlorobenzene, 1,2,4-trichlorobenzene, and spun in a poor solvent, i.e., a polar solvent such as water, methanol, or the like, to form a micro-size spherical base resin, and the resulting base resin is hybridized with carbon nano tubes using an equipment, for example, Hybridizer (Nara Machinery), Nobilta (Hosokawa Micron), Q-mix (Mitsui Mining) and so on, to produce hybrid particles.

Also, an embodiment may include 0.1 to 10 parts by weight of carbon black that is mixed with the carbon nano tubes. Because carbon black particles have a high specific surface area between 40 and 200 m$^2$/g, a slight reduction in the content of the carbon black may contribute to improving compounding, compounding rate, volume resistivity, extrusion performance and reproducibility, and besides, reducing the volume of scorch. Due to the use of the carbon nano tubes, an embodiment thus can achieve a smooth semiconductive layer without carbon black or with a small amount of carbon black. It results in thickness reduction of an inner semiconductive layer and/or an outer semiconductive layer, and consequently, a lightweight power cable. Accordingly, this may reduce the cost involved in distribution and installation of the power cable.

The semiconductive composition of an embodiment includes at least one kind of antioxidants, e.g., amines and derivatives thereof, phenols and derivatives thereof, and reaction products of amines and ketones. Also, to improve the heat resistant characteristics, the semiconductive composition of an embodiment includes at least one kind of antioxidants, e.g., reaction products of diphenylamine and acetone, zinc 2-mercaptobenzimidazorate and 4,4'-bis(α,α-dimethylbenzyl)diphenylamine. Alternatively, the semiconductive composition of an embodiment includes at least one kind of antioxidants, e.g., pentaerythritol-tetrakis[3-(3,5-di-tert-butyl-4-hydroxy-phenyl)-propionate], pentaerythritol-tetrakis-(β-lauryl-thiopropionate, 2,2'-thiodiethylenebis-[3-(3,5-di-tert, butyl-4-hydroxyphenyl)-propionate], and distearyl-ester of b,b'-thiodipropionic acid.

The insulation 3 is formed from an insulation composition containing a polypropylene baser resin or a low-density polyethylene baser resin and inorganic nano particles. The insulation composition of an embodiment does not contain a crosslinking agent, and thus crosslinking by-products are not created during manufacturing. Thus, in contrast with the conventional art, an embodiment may not have a need for a process for removing the crosslinking by-products and can save the process time and cost.

The insulation composition of an embodiment includes 0.1 to 5 parts by weight of at least one kind of inorganic nano particles, e.g., silicon dioxide ($SiO_2$), titanium dioxide ($TiO_2$), carbon black, graphite powder, and surface-modified cubic magnesium oxide, per 100 parts by weight of the base resin. In case of less than 0.1 parts by weight, a space charge reducing effect is achieved, but a DC dielectric breakdown strength is relatively lowered. In case of more than 5 parts by weight, there is a reduction in mechanical performance and continuous extrusion performance.

For example, magnesium oxide is surface-modified with vinyl silane, stearic acid, oleic acid, aminopolysiloxane, and so on. Typically, magnesium oxide is hydrophilic, i.e., having high surface energy, while the polypropylene base resin or a low-density polyethylene base resin is hydrophobic, i.e., having low surface energy, and thus, dispersion of magnesium oxide in the base resin is poor and electrical properties are deteriorated. To solve the problem, tone example may modify the surface of magnesium oxide.

Without surface modification of magnesium oxide, a gap is generated between magnesium oxide and the base resin, which causes a reduction in mechanical properties and electrical properties such as dielectric breakdown strength.

On the other hand, surface modification of magnesium oxide with vinyl silane allows excellent dispersion in the base resin and improved electrical properties. Hydrolysable groups of vinyl silane are chemically bonded to the surface of magnesium oxide by a condensation reaction, so that surface-modified magnesium oxide is produced. Next, a silane group of the surface-modified magnesium oxide reacts with the base resin, ensuring excellent dispersion.

For example, magnesium oxide has a purity between 99.9 and 100% and an average particle size of 500 nm or less, and may have both monocrystalline and polycrystalline structures.

Also, the insulation composition may further include 0.1 to 0.5 parts by weight of an antioxidant per 100 parts by weight of the base resin.

Hereinafter, embodiments will be described in detail through examples. However, the description proposed herein is just one example for the purpose of illustrations only, not intended to limit the scope of embodiments, so it should be understood that the examples are provided for a more definite explanation to an ordinary person skilled in the art.

Compositions of examples and comparative examples were prepared according to formulas of the following table 1, to find out changes in performance depending on the composition of a semiconductive composition and an insulation composition used to manufacture a DC power cable of an embodiment. The unit of content in Table 1 is parts by weight. The values beyond the numeric range of an embodiment are indicated in italics.

TABLE 1

| | Component | | Example 1 | Example 2 | Example 3 | Comparative example 1 | Comparative example 2 |
|---|---|---|---|---|---|---|---|
| Semiconductive composition | Base resin | | 100 | 100 | 100 | 100 | 100 |
| | Carbon nano tubes | | 6 | 4 | 4 | 0 | 0 |
| | Carbon black | | 0 | 5 | 10 | 28 | 33 |
| | Antioxidant | | 0.4 | | | 0.4 | |
| Insulation composition | Base resin | | 100 | 100 | 100 | 100 | 100 |
| | Magnesium oxide | Content | 2.0 | 2.0 | 2.0 | None | 2.0 |
| | | Shape | Cubic | Cubic | Cubic | | Terrace |
| | | Purity(%) | 99.95 | 99.95 | 99.95 | | 99.95 |
| | Antioxidant | | 0.4 | 0.4 | 0.4 | 0.4 | 0.4 |

[Components of Table 1]
Base resin: Low-density polyethylene resin (Density: 0.85~0.95 kg/m$^3$, Melt index (MI): 1~2)
Magnesium oxide: Powdery magnesium oxide surface-modified with vinyl silane.
Antioxidant: tetrakis-(methylene-(3,5-di-(tert)-butyl-4-hydrocinnamate))methane Property Measurement and Evaluation Semiconductor samples were prepared using the semiconductive compositions of examples 1 to 3 and comparative examples 1 and 2. The samples of examples and comparative examples were measured for semiconductive characteristics, i.e., volume resistivity and hot set, and the measurement results are shown in the following Table 2 where values below the standard are indicated in italic. The test conditions are briefly described as follows.

Figure 3:
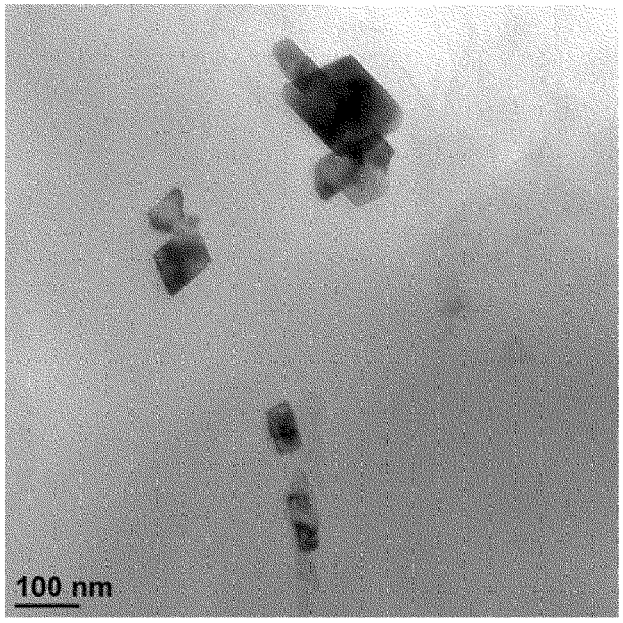
FIG. 3 is a TEM image of an insulation containing cubic magnesium oxide.

Also, master batch compounds were prepared using the insulation material compositions of examples 1 to 3 and comparative examples 1 and 2, and extruded using a twin screw extruder whose screw diameter is 25 mm (L/D=60). FIG. 3 shows, as a TEM image, that the resulting insulation of an embodiment contains cubic magnesium oxide.

The insulations according to examples 1 to 3 and comparative examples 1 and 2 were thermocompressed to manufacture each of 0.1 mm-thick samples for measuring volume resistivity and DC dielectric breakdown strength. The samples were then tested for volume resistivity and DC dielectric breakdown strength (ASTM D149), and the test results are shown in the following Table 2. The test conditions are briefly described as follows.

1) Volume Resistivity of Inner and Outer Semiconductors

The volume resistivity (Ω·cm) was measured at 25° C. and 90° C., respectively, when a DC electric field of 80 kV/mm was applied to the semiconductor samples.

2) Hot Set

The hot set test was carried out according to IECA T-562 by exposing the semiconductor samples under air atmosphere at 150° C. for 15 minutes.

3) Volume Resistivity of Insulation

The volume resistivity ($\times 10^{14}$ Ω·cm) was measured when a DC electric field of 80 kV/mm was applied to the insulation samples.

4) DC Dielectric Breakdown Strength

The DC dielectric breakdown strength (kV) of the insulation samples was measured at 90° C.

TABLE 2

| | Test item | | Example 1 | Example 2 | Example 3 | Comparative example 1 | Comparative example 2 |
|---|---|---|---|---|---|---|---|
| Semiconductor | Volume resistivity(Ω · cm) | 25° C. | 329.3 | 489.5 | 430.5 | 482.4 | 35 |
| | | 90° C. | 107.3 | 210 | 130 | 120000 | 1244 |
| | Hot set(%) | | 60 | 70 | 65 | 90 | 90 |
| Insulation | Volume resistivity($\times 10^{14}$ Ω · cm) | | 10 | 8 | 8 | 4 | 5 |
| | DC dielectric breakdown strength(kV/mm) | | 127 | 115 | 110 | 85 | 90 |

As shown in Table 2, the semiconductor samples manufactured using the semiconductive compositions of examples 1 to 3 according to an embodiment met all the standards for volume resistivity and hot set.

However, the semiconductor sample of comparative example 1 did not meet the standard for volume resistivity, and the semiconductor sample of comparative example 2 did not meet any standards for volume resistivity and hot set. This is resulted from the fact that the semiconductive compositions of comparative examples 1 and 2 do not contain carbon nano tubes but contain a large amount of carbon black.

Also, as seen from Table 2, the insulations of examples 1 to 3 according to an embodiment had relatively higher volume resistivity and DC dielectric breakdown strength than that of comparative example 1 (without magnesium oxide) and that of comparative example 2 (with terrace magnesium oxide). That is, it is found that the insulation samples of examples 1 and 2 according to an embodiment exhibited excellent electrical insulating characteristics because cubic magnesium oxide was used as a space charge reducing agent.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A power cable comprising:
a conductor;
an inner semiconductive layer;
an insulation; and
an outer semiconductive layer,
wherein at least one of the inner semiconductive layer or the outer semiconductive layer comprises a semiconductive composition comprising hybrid particles produced from:
a spherical polypropylene base resin or a spherical low-density polyethylene base resin; and
carbon nano tubes, and
wherein the insulation comprises an insulation composition comprising:
a polypropylene base resin or a low-density polyethylene base resin; and
inorganic nano particles.

2. The power cable according to claim 1, wherein the content of the carbon nano tubes is 1 to 6 parts by weight per 100 parts by weight of the base resin.

3. The power cable according to claim 2, wherein the semiconductive composition further comprises, per 100 parts by weight of the base resin:
0.1 to 10 parts by weight of carbon black; and
0.1 to 0.5 parts by weight of an antioxidant.

4. The power cable according to claim 2, wherein the carbon nano tubes comprise multiwalled carbon nano tubes comprising a diameter between 5 and 20 nm and a purity of 98% or more.

5. The power cable according to claim 1, wherein the semiconductive composition further comprises, per 100 parts by weight of the base resin:
0.1 to 10 parts by weight of carbon black; and
0.1 to 0.5 parts by weight of an antioxidant.

6. The power cable according to claim 1, wherein the carbon nano tubes comprise multiwalled carbon nano tubes comprising a diameter between 5 and 20 nm and a purity of 98% or more.

7. The power cable according to claim 1, wherein the insulation composition comprises 0.1 to 5 parts by weight of one or more kind of inorganic nano particles comprising: silicon dioxide ($SiO_2$), titanium dioxide ($TiO_2$), carbon black, graphite powder and surface-modified cubic magnesium oxide, per 100 parts by weight of the base resin.

8. The power cable according to claim 7, wherein the magnesium oxide comprises: a purity of 99.9% or more; and an average particle size of 500 nm or less.

9. The power cable according to claim 7, wherein the magnesium oxide is monocrystalline or polycrystalline.

10. The power cable according to claim 7, wherein the insulation composition further comprises 0.1 to 0.5 parts by weight of an antioxidant per 100 parts by weight of the base resin.

11. The power cable according to claim 1, wherein the insulation composition further comprises 0.1 to 0.5 parts by weight of an antioxidant per 100 parts by weight of the base resin.

12. The power cable of claim 1, wherein the power cable is a DC power cable suitable for use as a high voltage transmission line.

13. The power cable according to claim 1, wherein the insulation composition comprises a non-crosslinked polypropylene base resin or a non-crosslinked low-density polyethylene base resin.

* * * * *